US007755493B2

(12) United States Patent
Berenguer et al.

(10) Patent No.: US 7,755,493 B2
(45) Date of Patent: Jul. 13, 2010

(54) PROCESS AND DEVICE FOR REMOTELY TRACKING A PERSON'S ACTIVITY IN A BUILDING

(75) Inventors: Marc Berenguer, Revel (FR); Hervé Provost, Seyssinet-Pariset (FR); Floriane Gallay, Marcellaz en Faucigny (FR)

(73) Assignee: France Telecom, Paris (FR)

( * ) Notice: Subject to any disclaimer, the term of this patent is extended or adjusted under 35 U.S.C. 154(b) by 10 days.

(21) Appl. No.: 11/384,752

(22) Filed: Mar. 20, 2006

(65) Prior Publication Data

US 2006/0261962 A1 Nov. 23, 2006

(30) Foreign Application Priority Data

Mar. 24, 2005 (FR) ..... 05 02946

(51) Int. Cl.
*G08B 23/00* (2006.01)

(52) U.S. Cl. ..... 340/573.1; 340/539.12; 702/188; 702/2

(58) Field of Classification Search ..... 340/539.12, 340/573.1; 702/188, 2
See application file for complete search history.

(56) References Cited

U.S. PATENT DOCUMENTS 4,567,557 A * 1/1986 Burns ..... 340/538.11
4,644,320 A * 2/1987 Carr et al. ..... 340/538
4,858,141 A 8/1989 Hart et al.
4,990,893 A 2/1991 Kiluk et al.
5,692,215 A * 11/1997 Kutzik et al. ..... 340/573.4
5,706,191 A * 1/1998 Bassett et al. ..... 700/9
6,002,994 A * 12/1999 Lane et al. ..... 702/188
6,108,685 A * 8/2000 Kutzik et al. ..... 340/506
6,377,858 B1 * 4/2002 Koeppe ..... 700/12
6,611,206 B2 * 8/2003 Eshelman et al. ..... 340/573.1
6,617,972 B2 * 9/2003 Takarada et al. ..... 340/635
6,772,096 B2 * 8/2004 Murakami et al. ..... 702/184
6,796,799 B1 * 9/2004 Yoshiike et al. ..... 702/188
6,825,761 B2 * 11/2004 Christ et al. ..... 340/506
6,977,585 B2 * 12/2005 Falk et al. ..... 340/506
6,989,742 B2 * 1/2006 Ueno et al. ..... 340/539.14
7,124,184 B2 * 10/2006 Chung et al. ..... 340/825.52
7,242,305 B2 * 7/2007 Cuddihy et al. ..... 340/573.1
2002/0116342 A1 * 8/2002 Hirano et al. ..... 705/64
2005/0203647 A1 * 9/2005 Landry et al. ..... 700/83
2006/0033625 A1 * 2/2006 Johnson et al. ..... 340/573.1
2006/0109966 A1 * 5/2006 Sasakura et al. ..... 379/177

FOREIGN PATENT DOCUMENTS

EP 1 349 128 A 10/2003
FR 2 680 875 A 3/1993
FR 2 806 806 9/2001
JP 2000 156738 A 6/2000

* cited by examiner

*Primary Examiner*—Eric M Blount
(74) *Attorney, Agent, or Firm*—Drinker Biddle & Reath LLP

(57) ABSTRACT

Predefined electrical signals, produced by an electrical equipment in the building during a change of electrical operating state of said equipment, are detected on the building's power supply system. By analyzing each detected electrical signal, tracking data is generated including information relating to the date of detection, the electrical equipment originating the signal and the corresponding change in electrical state. At least one parameter representative of the activity carried out by said person is determined, in the form of a probability of an activity or a type of activity being carried out, based on tracking data generated during a predefined period of time.

16 Claims, 3 Drawing Sheets

PROCESS AND DEVICE FOR REMOTELY TRACKING A PERSON'S ACTIVITY IN A BUILDING

FIELD OF THE INVENTION

The invention relates to the field of measurement and remote tracking of a person's activity, and more specifically concerns a process and device for remotely tracking a person's activity in a building.

BACKGROUND OF THE INVENTION

The systems that have been developed in this field are mostly designed for tracking persons regarded as "frail", typically elderly people living alone. Their function is to detect as early as possible any abnormal change in the activity of these persons so as to trigger, where necessary, the intervention of an emergency service, doctor or relative of the person.

Current known systems for remotely tracking a person in their house, use a set of sensors distributed in a way adapted to this house. These systems require installing numerous dedicated sensors, such as door or window contact sensors, actimetric mattress sensors, pressure-sensitive floor sensors, laser beam or infrared presence detectors, usage detectors in the form of a counter on everyday pieces of equipments (coffeemaker), etc.

These systems are especially expensive to install, often needing considerable work to install them or entail the availability of numerous power supply access points. Furthermore, some detectors used in these systems are often lacking in reliability since disturbances occur in the surveilled environment that are associated with the presence of persons other than the person to be tracked, the presence of pets, or simply disturbances associated with air currents or rays of sunlight temporarily heating a part of the house.

These systems can further cause in the person being tracked the unpleasant feeling of being "surveilled" due to the visible omnipresence of the means of detection, which often forms a major obstacle to installing such systems.

SUMMARY OF THE INVENTION

One object of the present invention is to provide a process and device for remotely tracking a person's activity in a building which does not have the drawbacks disclosed for previously known solutions, and in particular can be used for reliably tracking this activity while being simple and inexpensive to install.

These and other objects are attained in accordance with one aspect of the present invention directed to a method for remotely tracking a person's activity in a building. This method includes obtaining, from a detection device capable of detecting in said building's electrical power supply system at least one predefined electrical signal produced by a piece of electrical equipment of said building when a change of electrical operating state occurs in said piece of electrical equipment, tracking data relating to at least one detected electrical signal. The tracking data includes information relating to the detection moment of said at least one detected electrical signal, identification data of said piece of electrical equipment which produced said at least one detected electrical signal, and data relating to said change of electrical operating state which caused said at least one detected electrical signal. This method also includes determining, from tracking data generated during a predefined period of time, an estimate of said person's degree of activity.

The invention exploits the fact that it is possible to detect a change in electrical operating state of an equipment by detecting electrical signals produced on the electrical power supply system. Such a change in electrical operating state occurs especially when a user switches on or switches off either the equipment itself or an electrical subassembly of this piece of equipment. It is therefore possible to detect the use of this piece of equipment from the electrical signals produced on the electrical power supply system.

Furthermore, the detection of electrical signals can be performed in an extremely simple way, for example, using a simple clamp-on ammeter. This detection technique can be further used to ascertain the use of all the building's electrical pieces of equipments, and this from one single electrical detection point. The invention thus avoids installing numerous sensors in a system for remotely tracking a person's activity.

According to an embodiment another feature of the invention, said estimate is determined in the form of at least one activity indicator representative of the probability of at least one type of activity being carried out by said person during said period of time.

A probabilistic type of analysis proves appropriate for processing information associated with the detection of predefined signals produced by electrical equipment. It is also sufficient for detecting variations in the behavior of the person to be tracked.

According an embodiment of the invention, the method includes associating at least one electrical equipment with each activity indicator, assigning, to each electrical equipment associated with an activity indicator, a weighting value that is representative of the probability of performance of the type of activity of which this indicator is representative when an action causing a change of electrical state of said at least one equipment is carried out by the person on said at least one the equipment, and determining an activity indicator from the weighting values determined for said at least one electrical equipment associated with this activity indicator.

Generating a weighting value for an equipment according to the type of activity with which it may be associated falls within a context of probabilistic analysis. It makes the method of determining activity indicators independent of the nature of the various pieces of equipments considered since these are taken into account according to the weighting value assigned to them.

According to another feature of the invention, the weighting value relating to a given equipment and a given activity indicator is weighted according to at least one criterion chosen from among the group including

- the time of day,
- the total number of electrical equipments associated with said activity indicator,
- the total number of electrical equipments detected and associated with said activity indicator,
- the period during which the equipment has remained switched on,
- the number of times that the equipment has been switched on or off,
- the outside temperature,
- the season,
- the day of the week,
- the degree of confidence in the identification data,
- the person's habits,
- the number of electrical equipments associated with the same activity indicator and switched on shortly before or shortly after the equipment.

In this way, the determination of activity indicators is adapted simultaneously to the degree of equipment of the building, the season, the time of day and to the usage characteristics of the electrical equipment. It is therefore possible to determine the activity indicators in a detailed way appropriate to the person to be tracked, their type of housing and their way of life. The activity indicators thus obtained are especially relevant and representative of the person's activity.

According to another feature of the invention the method according to the invention further includes a step of determining at least one relative activity indicator representative of the normal character of the person's activity in said building over a period of time by comparison of at least one activity indicator determined for said period of time with a reference activity indicator relative to a same period of time.

This relative activity indicator forms a global measurement of the person's activity. It facilitates tracking a large number of people and enables automated tracking based on the value of this global measurement. It enables, for example, triggering an alert conditional upon the value of this relative activity indicator.

According to another feature of the invention, a change in electrical state occurs following an action performed by the person on the electrical equipment, this action might be the switching on or off of the electrical equipment or of an electrical subassembly of the electrical equipment. In this case, the tracking data includes information on the nature of the action (switching on/switching off) causing the change in electrical state.

This information, used in combination with information on the date of detection, can be used to easily determine information relating to the total duration of use of this equipment (by difference between the date of switching off and the date of switching on) or relating to the usage time slot of this equipment.

In accordance with another aspect of the invention there is also provided a data processing device for remotely tracking a person's activity in a building, including means for obtaining, from a detection device capable of detecting in said building's electrical power supply system at least one predefined electrical signal produced by a piece of electrical equipment of said building when a change of electrical operating state occurs in said piece of electrical equipment, tracking data relating to at least one detected electrical signal. The tracking data includes information relating to the detection moment of said at least one detected electrical signal, identification data of said piece of electrical equipment which produced said at least one detected electrical signal, and data relating to said change of electrical operating state which caused said at least one detected electrical signal. Also, included in the device is data processing means for determining, from tracking data generated during a predefined period of time, an estimate of said activity carried out by said person.

This data processing device is preferably implemented in the form of a computer server.

In accordance with another aspect of the invention there is also provided a device for remotely tracking a person's activity in a building including a detection module for detecting on said building's electrical power supply system at least one predefined electrical signal produced by an electrical equipment of said building when a change of electrical operating state occurs in said piece of electrical equipment. A means is provided for generating tracking data, by analysis of at least one detected electrical signal, wherein the detected electrical signals include information relating to the detection moment of said at least one detected electrical signal, identification data of said piece of electrical equipment which produced said at least one detected electrical signal, and data relating to said change of electrical operating state which caused said at least one detected electrical signal. The device also includes data processing means for determining, from tracking data generated during a predefined period of time, an estimate of said activity carried out by the person.

The advantages set out briefly earlier for the process according to the invention can be transposed to this data processing device and this tracking device.

DETAILED DESCRIPTION OF THE DRAWINGS

Figure 1:
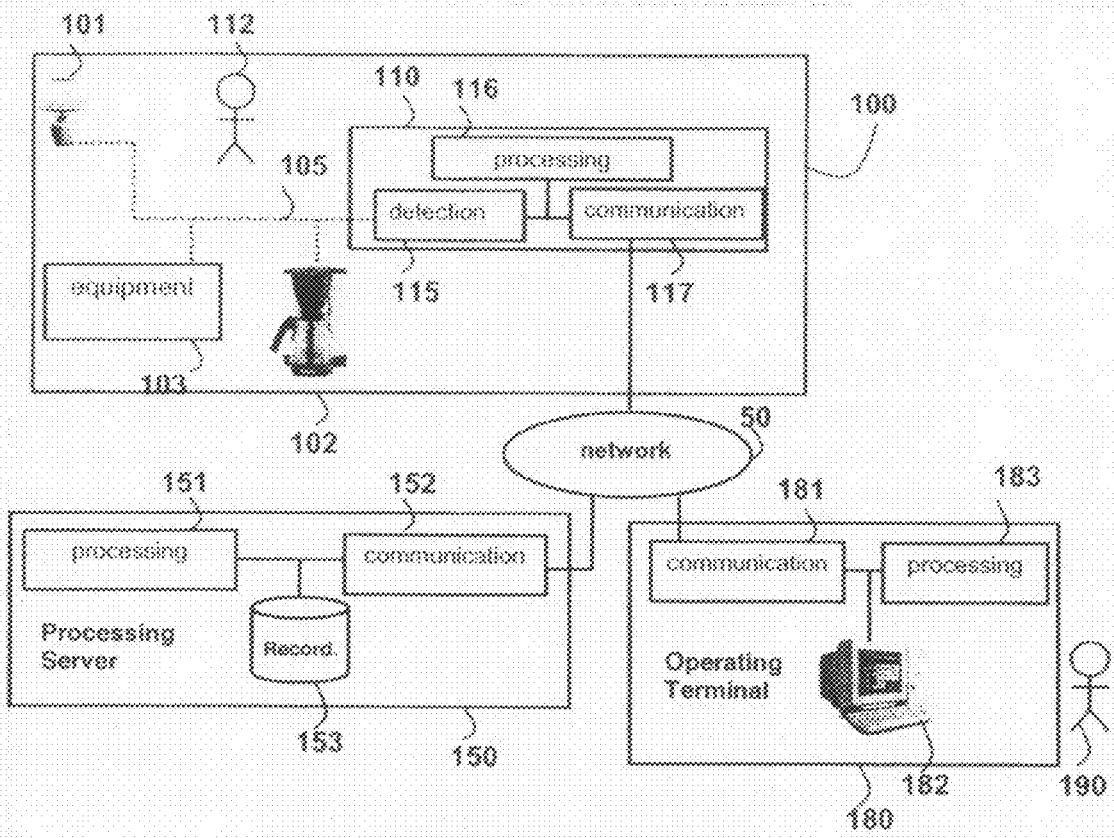
FIG. 1 is a schematic representation of an embodiment of a system adapted for implementing the process according to the invention.

Referring to FIG. 1 an embodiment of a system adapted for implementing the process according to the invention will be disclosed. As shown in FIG. 1, such a system comprises a communication network 50 to which are connected:

a detection device 110 connected to the electrical power supply system 105 of the building 100 of the person 112 whose activity has to be surveilled;

a processing server 150 adapted for communicating via the communication network 50 with the detection device 110;

an operating terminal 180 adapted for communicating via the communication network 50 with the processing server 150;

In the chosen example shown, the detection device, the processing server and the operating terminal are distinct entities, however, according to a variant embodiment, the processing server and the operating terminal may be assembled together geographically and integrated into a single computer device incorporating the processing server and operating terminal functions. Likewise, according to another variant embodiment, the detection device and the processing server may be merged into a single computer device incorporating the functions provided by the processing server and the detection device.

In order to be able to communicate via the communication network 50, the detection device 110, the processing server 150 and the operating terminal 180 respectively include means of communication 117, 152 and 181 adapted to the nature of the communication network 50, for example, conventional PSTN modems in the case of a switched telephone network (PSTN). The network 50 may also be an Internet type network, a private network, a mobile telephone network, a WIFI type wireless network, etc. The method of transmitting information between the different entities of the system is also adapted to the nature of the network. In the case of a mobile telephone network, this transmission is carried out, for example, via the intermediary of SMS (short message service) type short messages.

The building 100 includes a set of electrical equipment connected to the electrical power supply system 105. As shown in FIG. 1, this equipment is, for example, a lamp 101, a coffeemaker 102, or any other electrical equipment 103.

The detection device 110 fitted in the building in accordance with the invention, includes a module 115 for detecting and acquiring electrical signals generated on the electrical power supply system 105. Each of the detected electrical signals is produced by one of the building's pieces of electrical equipment when the equipment in question changes electrical operating state. Most often the change in operating state is due to the electrical equipment considered being switched on or off.

In fact, it has been found that switching a piece of electrical equipment on or off generates a high frequency (HF) electrical signal on the power network to which the equipment is connected, which is representative of the electrical equipment and of the nature of the action that triggered the signal. This HF signal is furthermore independent of the power consumption of the electrical equipment considered.

Figure 2A:
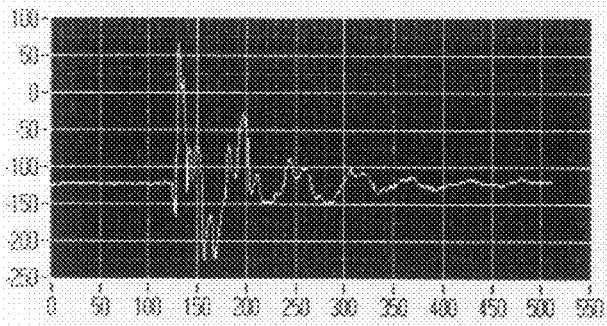
FIGS. 2*a* and 2*b* show examples of electrical signals from which activation of an electrical piece of equipment is detectable.
Figure 2B:
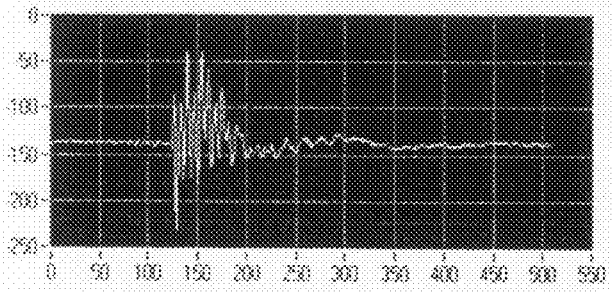

Examples of such electrical signals are shown as a function of time in FIGS. 2*a* and 2*b*. These figures respectively depict the electrical signal obtained when switching on an electric coffeemaker and that obtained when switching off the coffeemaker.

When their high frequency components are compared, these signals display sufficient differences between them to enable the piece of equipment and the action that triggered the signal to be identified from a record of these signals. Such signals therefore constitute an electromagnetic signature for the piece of equipment and the action that has triggered the signal. Accordingly, the electrical equipment that is switched on or off, is identifiable through analysis of the electrical signal generated on the network at the instant of switching on/off.

Simple electrical pieces of equipments, like an electric light bulb, often have only two signatures, a signature for switching on and a signature for switching off.

A more complex electrical piece of equipment such as a washing machine typically operates in a cyclic process. During the same use cycle (pre-wash, wash, rinse, drain, dry, etc.) such a piece of equipment may therefore display a different electromagnetic signature according to the phases of this cycle, especially because of the various electrical elements present and active in the piece of equipment at each phase.

In the case of an electrical piece of equipment of the freezer or refrigerator type, the switching on and off of the piece of equipment itself is not detected, but that of the interior lighting system which is activated by opening or closing the door of the piece of equipment. In this case, in fact, the action of interest for measuring activity is the opening and closing of the door, is the switching on or off of the interior lighting system respectively. The electrical signals caused by the starting or stopping of the cold control system in such pieces of equipments are not in themselves relevant to analyzing activity as envisaged in the context of the invention.

According to one example of embodiment, the detection module 115 is made from a clamp-on ammeter for measuring HF electrical signals, coupled with an electronic circuit for digitizing and recording the high frequency electrical signal measured via the clamp-on ammeter.

An example of embodiment of such a detection module is disclosed in patent document FR 2 806 806. This module, produced in the form of a package, requires a simple electrical connection onto the electrical power supply system, for example, at the building's electric meter. It is therefore especially discreet and does not give an impression of intrusion to the person who is to be tracked. Finally, it is no longer necessary to install a plurality of sensors, since, via the intermediary of this single package, it is possible to detect the activation, and thus the use, of all the electrical equipment in the building.

The detection module 115 is furthermore adapted for recording date and time information relating to the moment of detection, for each electrical signal detected.

Turning back to FIG. 1, the detection device 110 further includes a data processing module 116, designed, for example, around a microprocessor. The data processing means 116 are adapted for analyzing the HF electrical signal and, following the detection and acquisition of the aforementioned high frequency signal, generating tracking data comprising:

- the moment or date (day and/or hour) of detecting the electrical signal,
- identification data of the electrical equipment that has produced the electrical signal,
- data characterizing the change of electrical operating state that has triggered the electrical signal.

According to a variant embodiment, the tracking data further includes a confidence score, that is to say, a numeric value indicative of the degree of confidence in the identification of the equipment obtained through the identification data.

The date and time of detecting the electrical signal are, for example, obtained from a clock signal present in the detection device, the date and time recording being triggered by the detection of the electrical signal.

The characterization data is used to characterize the change of electrical operating state by giving an indication relating to the action on the electrical equipment which caused the electrical signal. This action can be the switching on or off of the electrical equipment or the switching on or off of an electrical subassembly of the electrical equipment. In this case, the characterization data indicates whether switching on or switching off has been identified by analysis of said electrical signal.

The identification data of the electrical piece of equipment as well as the identification of the action that has triggered the electrical signal are obtained by comparison between the detected high frequency signal, previously digitized and filtered by means of a high-pass filter, with a corresponding reference signal, which has been prerecorded during a learning phase of the detection device 110.

A reference signal is thus prerecorded during the learning phase for each action generating an electrical signal and each piece of electrical equipment considered. In particular, for each piece of equipment, at least two reference signals are prerecorded corresponding to switching the equipment, or an electrical subassembly of this equipment, on and off respectively.

According to one example of embodiment, the comparison of the detected signal with the prerecorded reference signals is performed by means of a signal correlation algorithm. In this way, by searching for the maximum correlation, both the electrical equipment involved in the detection and the action (switching on or switching off) that has triggered the signal, can be determined.

The aforementioned confidence score which may be included in the tracking data, is, for example, defined based on the level of correlation obtained between the detected electrical signal and the reference signal for which correlation is best. A low correlation level, corresponding to a weak correlation, thus indicates that there is a doubt about the identification of the electrical piece of equipment.

As mentioned earlier, the detection device 110 includes communication means 117, which are used for transmitting the tracking data obtained following a detection, to the processing server 150. The latter then analyzes the data received.

The fact of shifting the tracking data analysis onto the processing server 150 enables the detection device 110, installed at the home of the person to be tracked, to be reduced and enables more powerful data processing means to be used, remotely installed in the processing server 150.

In addition, the processing server may, according to its processing capacity, be in communication via the communication network 50 with a plurality of detection devices 110 each placed at the home of a different person.

As a variant, the generation of a part of the tracking data is performed not in the detection device, but in the processing server itself. In this case, after each detection the detection device only transmits the digitized electrical signal and the date and time of detection to the processing server. The identification data of the equipment together with the data characterizing the use that is made of it by a type of action, can then be determined by the processing server if this server has the reference signals of each piece of equipment and of each action to be detected.

The processing server 150, in addition to the means of communication 152, comprises data processing means 151, typically one or more computer processors, and means 153 of recording data, typically one or more computer hard disks.

The processing server 150 is in functional communication with the operating terminal 180. The operating terminal 180, in addition to the means of communication 181, comprises data processing means 183, typically one or more computer processors, and means 182 of displaying data, typically a display screen.

Figure 3:
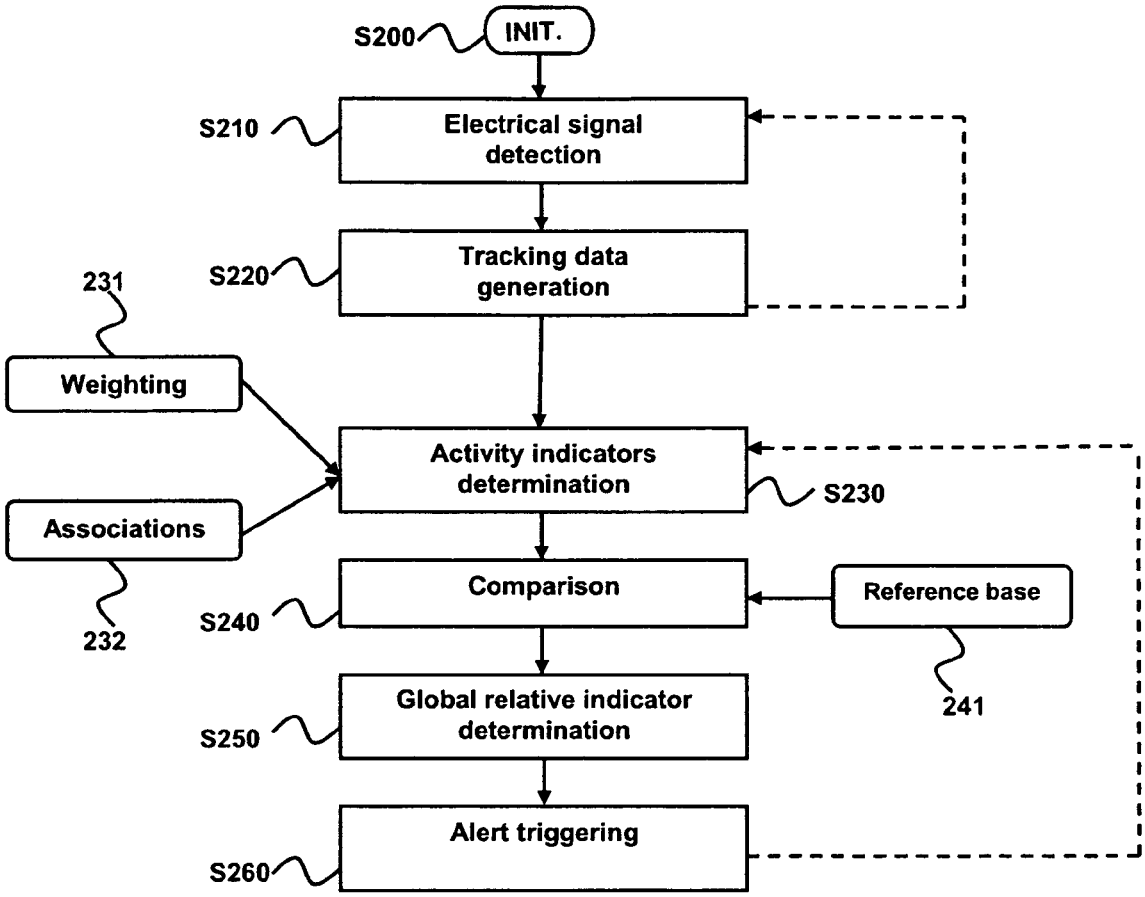
FIG. 3 is a flow chart illustrating the steps of a tracking process according to the invention.

Referring to FIG. 3, a process according to the invention for tracking a person's activity will now be disclosed. As shown on the flow chart in FIG. 3, the tracking process begins with an initialization step S200, then continues through steps S210 to S260. The process comprises two distinct phases, which may each be executed independently of the other, and cyclically:

- the first phase or tracking data detection and acquisition phase, corresponding to steps S210 and S220, and
- the second phase or tracking data analysis and processing phase, corresponding to steps S230 to S260.

For the same process implementation cycle, the first phase may be repeated several times before executing the second phase, and the execution of the second phase assumes at least one execution of the first phase.

In preference, the second phase is executed periodically, for example hourly, based on the tracking data generated during the period considered, while the first phase is triggered by the detection of an electrical signal on the electrical power supply system, and may be executed at any time and in parallel with one of the steps of the second phase.

The aforementioned two phases are preferably executed by two independent devices distributed around the network 50, namely the detection device 110 and the processing server 150.

At step S210, the detection device 110 detects a high frequency electrical signal on the electrical power supply system 105.

At step S220 which follows, the detection device 110, by analyzing the detected electrical signal, generates tracking data comprising:

- data (day and/or hour) relating to the moment of the performed detection,
- identification data of the piece of equipment that has triggered the electrical signal, together with
- data relating to the usage that has triggered the electrical signal.

The tracking data generated by the detection device 110 is then transmitted via the communication network 50, to the processing server 150, which records it. The set of tracking data stored in the processing server forms a log of the various detections that have taken place in a given period of time.

The table below provides an example of tracking data recorded over a given period of time, in this example from 12:50 am to 4:55 pm. Thus each record includes a date and time, an identification of the identified electrical piece of equipment and the operating state of the piece of equipment (on or off) resulting from switching the piece of equipment on or off.

| Date | Time | Piece of equipment | Action/State |
|---|---|---|---|
| 05/07/2004 | 12:50:05 | coffeemaker | on |
| 05/07/2004 | 12:50:40 | coffeemaker | off |
| 05/07/2004 | 12:50:58 | light 1 | on |
| 05/07/2004 | 12:51:17 | light 1 | off |
| 05/07/2004 | 13:36:52 | light 2 | on |
| 05/07/2004 | 13:36:53 | light 2 | off |
| 05/07/2004 | 13:38:58 | hair dryer | on |
| 05/07/2004 | 13:39:08 | hair dryer | off |
| 05/07/2004 | 13:39:27 | coffeemaker | on |
| 05/07/2004 | 13:39:41 | coffeemaker | off |
| 05/07/2004 | 13:39:49 | light 1 | on |
| 05/07/2004 | 16:54:21 | light 2 | on |
| 05/07/2004 | 16:54:38 | light 1 | off |
| 05/07/2004 | 16:55:09 | light 2 | off |

The second phase of the process, corresponding to steps S230-S260 of analyzing and processing tracking data, is preferably triggered periodically, even in the absence of detected data, particularly in order to enable triggering an alert in such a situation.

However, since the distribution of a person's activities over time is subject to fluctuations, it is necessary to set the period of execution of this second phase of the process to a value that remains greater than a predetermined threshold value, for example to 15 minutes (mn), a value below which the analysis of tracking data relating to this single period is not significant.

Optionally, the data analysis may be performed at time intervals closer together but over a sliding time window, whose width is predefined, for example set to 1 hour (h), 6 h or 24 h. As a variant, the data analysis may be carried out over several sliding time windows, for example over a window of 1 h, over a window of 6 h and over a window of 24 h. In this way, both brief fluctuations in activity (for example, the person has not arisen at the normal time or no detection has taken place in the last hour) and average fluctuations over a day (for example, the person has only eaten once in the last 24 h or has almost not moved in the last 24 h) can be detected.

At step S230, the processing server 150 determines the activity indicators relating to different types of the person's activities, from the tracking data. These activity indicators are preferably indicators used in the medical field, for example an ADL ("Activities of Daily Living") indicator in accordance with the Katz scale or an IADL ("Instrumental Activities of Daily Living") indicator in accordance with the Lawton scale. ADL indicators relate to various types of basic activity: washing, dressing, going to the bathroom, moving around, being continent, eating. IADL indicators relate to supplementary types of activity, namely: telephoning, shopping, preparing a meal, doing housework, doing the laundry, using transportation, taking medication, financial management. For each of these indicators, between 3 and 7 levels are distinguished as necessary for characterizing the degree of the person's independence or dependence for each of these types of activity.

According to one embodiment, the indicators are determined according to a predetermined set of parameters representing rules of association 232 and weighting criteria 231. These parameters are tailored to a given person according to the level of electrical equipment of their home and/or according to their habits.

The person's habits are determined during a preliminary interview conducted, for example, by a doctor. The level of electrical equipment is determined for them when the detection device is installed and after identifying the various pieces of equipments that will be covered during detection. These parameters are preferably determined before the process is initialized, then recorded to be reused at each iteration of the process.

The purpose of the rules of association is to define whether an electrical equipment is representative of a given type of activity. Thus, one or more activity indicators are associated with each piece of detectable electrical equipment according to the nature of the equipment and/or its location in the building. The activity indicators associated with one electrical equipment are those for which the probability that the type of activity of which this activity indicator is representative is being carried out during the use of the electrical equipment, is significant or simply not zero.

According to a variant embodiment, each piece of electrical equipment is associated with the room of the house in which it is located. Then, one or more activity indicators are associated with each room according to the nature of the activity to which this room is devoted. For example, all the electrical equipment belonging to the kitchen will be associated by this method with the kitchen and therefore the activity of "eating" or "preparing a meal". Thus, even electrical equipment usually insignificant for a given activity is taken into consideration for determining the activity indicator relating to this activity. For example, the act of turning on a light in the kitchen does not mean that the person is going to eat or is in the process of eating. However, the act of turning on a light in the kitchen, if it is simultaneous with the act of turning on an electric hotplate, reinforces the probability that the person is going to eat or is in the process of eating.

The table below is an example of definition of associations between electrical pieces of equipments, rooms in the house and activity indicators. In this example the activity of "eating" or "cooking" is associated with the kitchen and the list of electrical equipment in this kitchen. The activity of "dressing" is associated with the bedroom and the list of electrical equipment in this bedroom. The activity of "housework" is associated with all the rooms and the list of equipment including the vacuum cleaner and the iron. The activity of "moving around" is associated with all the rooms and electrical equipment of all the rooms, in particular with the electric lights in all the rooms.

| Activity indicators | Rooms | Electrical pieces of equipments involved |
|---|---|---|
| Eating<br>Cooking | Kitchen | Light bulbs, lights, range hood, heating, hotplate, oven, microwave, kettle, coffee-maker, toaster, mixer, dish-washer, washing machine, refrigerator, freezer, food processors, radio |
| Dressing | Bedroom | Light bulbs, bedside light, heating, television, radio, CD player, electric shutters |

-continued

| Activity indicators | Rooms | Electrical pieces of equipments involved |
|---|---|---|
| Washing<br>Doing laundry | Bathroom | Light bulbs, mirror lighting, heating, hair dryer, razor, electric toothbrush, washing machine, dryer, water-heater |
| Going to the bathroom | Toilet | Light bulbs, electric heating |
| Moving around | All the rooms | Light bulbs, pieces of equipments in each room |
| Housework | All the rooms | Vacuum cleaner, iron |
| Telephoning | Hallway | Light bulbs, telephone |
| Other | Dining room | Television, VCR, light bulbs, radio, computer, lights, fan |

The advantage of such rules of association is that it is not necessary to make an exact plan of the location of the electrical equipment. Only their assignment to a room is recorded, which considerably simplifies the work of setting the parameters of the device.

Such data tables can be used to store in the memory of the processing server 150 the associations defined for a given piece of equipment, for a given room or for a given activity indicator. These associations are recorded, for example, using tables or using relational databases in which the list of available electrical equipment, the list of rooms, the list of activity indicators and the association relationships between these various entities are recorded. Any other form of recording may also be envisaged.

When the building comprises a single room (the case of a studio apartment), it is possible to define "virtual rooms", corresponding to building zones which are used instead of normal rooms. For example, in a studio apartment, the "kitchen" may be defined as the building space that is occupied by the kitchenette or "kitchen corner" fitted into the studio apartment. The concept of a room in the context of the invention therefore does not necessarily imply a part of the building considered being bounded by walls or partitions, but corresponds to a part of the building that is assigned to a given functionality.

Based on predefined rules of association, weighting values are determined prior to the execution of step S230 of the process according to the invention. For each piece of detectable electrical equipment and for each activity indicator with which this electrical equipment is associated, a weighting value is determined representative of the probability that the type of activity of which this activity indicator is representative, is carried out when this equipment is used. In other words, the more the use of the equipment confirms that the person is carrying out an activity of the given type, the greater will be the weighting associated with this piece of equipment for this activity.

For example, for the "eating" activity indicator, which is characterized by the "kitchen" room, the "electric hotplate" equipment will have a weighting value higher than the kitchen "light bulb" equipment. It is actually more probable that a person will eat when they use the electric hotplate than when they turn on the kitchen light.

In preference, the weighting value relating to a given piece of equipment and a given type of activity is weighted according to at least one criterion chosen from among the group comprising:

the time of day, the total number of pieces of electrical equipment associated with the type of activity, the total number of pieces of electrical equipment detected and associated with the type of activity, the period during which the equipment has remained switched on, the number of times that the equipment has been switched on or off, the outside temperature, the season, the day of the week, the degree of confidence in the identification data, the person's habits, the number of pieces of electrical equipment associated with the same type of activity and switched on shortly before or shortly after the equipment.

The time of day is a weighting criterion used for characterizing the normal times of carrying out a type of activity. When the piece of equipment is used in the normal time slot, the activity indicator and the weighting value assigned to said piece of equipment will be higher than when it is used outside this time slot. For example, if the electric hotplate is turned on between 11:30 am and 2:30 pm or between 6:00 pm and 9:00 pm, then the "eating" activity indicator will be more significant than if it is turned on at 4:00 am.

The activity indicator also depends on the state (on or off) of other pieces of equipments listed in the same room. If some of them are on at the same time, the probability that the person is carrying out the corresponding type of activity is greater and the activity indicator is higher. For example, if the range hood starts up at the same time as the electric hotplate, the probability of carrying out the activity of "eating" is greater than if it had been only the range hood. A given activity indicator is therefore preferably determined based on all the weighting values assigned to the pieces of equipments associated with this indicator.

In addition, since the number and type of pieces of equipments vary in each building, the activity indicator must be capable of being calculated according to different weighting values. For example, if person A has only an electric hotplate in their kitchen, and if person B has 10 electrical pieces of equipments, the activity indicator calculation must take into account the number of pieces of equipments. If the same weighting values are assigned to the equipment of both persons, then person A will never have a sufficiently high activity indicator to confirm performance of the "eating" activity even though it has well and truly taken place.

Moreover, the activity indicator may vary according to the time the piece of equipment is on, in the sense that the piece of equipment being on is only relevant starting from a certain minimum period of use that will have been previously defined. For example, if an oven is turned on for 30 minutes, it will come into the activity indicator calculation. But if it has been turned on for a minute then turned off, this use is not taken into account for calculating the activity (weighting value zero) or is only taken into account with a lower weighting value.

If the number of times a detected piece of equipment is turned on and off corresponds to normal use of this piece of equipment, then the weighting value associated with this piece of equipment, and therefore the indicator that is deduced from it, will be that much higher.

It is also relevant that the weighting value associated with a piece of equipment takes into account not only the season, but also the climate and the outside temperature, without any additional sensor. For example, at the height of summer, at midday on a sunny day, a person may cook and eat their meal in their kitchen without turning on the light since there is enough daylight in the room. The date of detecting the activation of a piece of equipment is used to adjust the weighting values of lighting pieces of equipments, either as a function of sunrise and sundown or sunshine hours, or as a function of the estimated average temperature for the season.

The weighting value associated with a piece of equipment, and therefore the indicator that is deduced from it, also depends on the confidence score of the detection carried out. In the event of any uncertainty regarding the piece of equipment detected, its activation is not taken into account for calculating the activity or is only taken into account with a lower weighting value.

In preference, the various weighting values are determined taking into account information known to the doctor regarding the habits of the person to be tracked and/or according to a learning phase previously carried out at the patient's home and which provides references concerning their living habits, for example, the number of their movements, their meal times, the rooms most often occupied, unused electrical pieces of equipments, the days of the week with different timetables, etc.

The activity indicator may be further refined according to pieces of equipments not only used simultaneously, but also those used just after or just before another piece of equipment belonging to the same room, or those used during a defined time slot. For example, if the oven is started up after turning off the hotplate, the probability that a meal is being cooked is greater than if it had only been the oven.

The table below gives an example of taking the time of day into account in the weighting assigned to a given piece of equipment. In this example, when determining the "eating" activity indicator, the predefined list of equipment considered comprises: light bulbs, hotplates, microwave, kettle, coffeemaker, toaster, freezer, range hood and refrigerator. If the toaster is detected being switched on in the time slot from 5:00 am to 9:00 am, the weighting value will be higher than if this detection took place in another time slot. Similarly, if the freezer is detected being used in the time slot from 11:00 am to 2:00 pm, the weighting value will be higher than if this detection took place in another time slot. The time slot considered may also vary according to the day of the week.

| Time of day | Time interval | Weighting value of the piece of equipment according to the time of day | |
|---|---|---|---|
| Breakfast | [5:00 am-9:00 am] | light bulbs | 1 |
| | | hotplates | 3 |
| | | microwave | 3 |
| | | kettle | 3 |
| | | coffeemaker | 3 |
| | | toaster | 3 |
| | | freezer | 0 |
| | | range hood | 1 |
| | | refrigerator | 2 |
| Lunch | [11:00 am-2:00 pm] | light bulbs | 1 |
| | | hotplates | 3 |
| | | microwave | 3 |
| | | kettle | 3 |
| | | coffeemaker | 3 |
| | | toaster | 0 |
| | | freezer | 2 |
| | | range hood | 3 |
| | | refrigerator | 2 |

The table below gives an example of taking another weighting criterion into account, the duration of use, in the weighting assigned to a given piece of equipment. For each piece of electrical equipment, a minimum relevant duration of use is defined below for which detecting the use of an electrical equipment is not taken into account for a given activity. This minimum data is, for example, chosen as follows:

| Piece of equipment | minimum relevant duration |
|---|---|
| Kettle | 1 mn |
| Coffeemaker | 2 mn |
| Hotplate | 5 mn |
| Oven | 10 mn |
| Microwave | 5 s |
| Toaster | 30 s |
| Mixer | 3 s |
| Refrigerator | 3 s |
| Freezer | 3 s |

The influence of the various weighting criteria on the weighting values or the calculation of activity indicators can be taken into account in a similar way to that disclosed for the time on or the use time slot.

In general, the weighting values associated with criteria which are independent of the detections performed (for example, criteria linked to the person's habits, the time slot, the season, the level of electrical equipment of the building, etc.) are preferably predetermined using tables. The other weighting values, which are dependent on the detections carried out (for example, criteria linked to the number of pieces of equipments detected, to the confidence score of the detection, to the time of the piece of equipment being on), are themselves determined dynamically from the tracking data recorded.

To take into account a plurality of weighting criteria, several weighting methods are possible.

According to a first weighting method, a representative global weighting value is determined according to these equipment use relevance criteria in the determination of a given activity indicator. This global weighting value is obtained, for example, by weighted mean or multiplying weighting values (in each case where they are normalized between 0 and 1) obtained according to each of the criteria considered individually.

According to a variant implementation of this first weighting method, the weighting values associated with different time slots, given days of the week or different calendar periods, are stored in different tables, one table corresponding each time to a given time slot, day of the week and calendar period.

According to a second weighting method, successive iterations are performed for applying different weighting criteria. For example, for determining the "eating" activity indicator relating to the period from 5:00 to 9:00 am (breakfast), the following steps are executed:

from among the tracking data recorded, only that for pieces of equipments detected in this time slot is retained, from among the selected pieces of equipments, only those that are relevant to the "eating" activity are retained, i.e. those associated with the kitchen, from among these only those whose duration of use is greater than the minimum duration of use are retained.

The pieces of equipments retained have a predefined weighting value that is set, for example, between 1 and 3, the weighting value of 3 corresponding to the highest level of probability. Three cases then present themselves:

a) if at least one of the pieces of equipments has a weighting value of 3, the activity indicator is at least 75%;

b) otherwise, if at least one of the pieces of equipments has a weighting value of 2, the activity indicator is at least 60%;

c) otherwise, it is considered that there is only an indication of presence in the kitchen and the indicator is set to a value between 0 and 60%, the weighting between the value 0% and the value 60% being a function of the percentage of pieces of equipments detected having a weighting value of 1 among the pieces of equipments associated with this indicator and this time slot.

In case a), the value of the indicator will be between 75% and 100%, the value of 100% corresponding to the detection of all the pieces of equipments associated with this indicator and this time slot. Weighting between the 75% value and 100% value depends on the number of pieces of equipments detected for this indicator and this slot, and the respective weighting values of these pieces of equipments. The remaining 25% between 75% and 100% are preferably distributed in proportion to the weighting values of the electrical pieces of equipments associated with this indicator, other than that detected at a weighting value of 3 at step a). Thus if the pieces of equipments considered for the remaining 25% are 3 in number, two of which have a weighting value of 2 and one a weighting value of 1, the first two each represent a probability of 10% each and the last a probability of 5% (2*10%+1*5%=25%). For this purpose it is assumed that the probability assigned to a piece of equipment with a weighting value of 2 is double that of a piece of equipment with a weighting value of 1.

If therefore in case a) a single piece of equipment with a weighting value of 2 is detected, the activity indicator finally obtained is:

75%+10%=85%.

If a piece of equipment with a weighting value of 2 and a piece of equipment with a weighting value of 1 are detected, the activity indicator finally obtained is:

75%+10%+5%=90%.

In case b), the value of the indicator will be between 60% and 75%, the value of 75% corresponding to the detection of all the pieces of equipments associated with this indicator and this time slot, except those having a weighting value of 3. Weighting between the 60% value and 75% value depends on the number of pieces of equipments detected for this indicator and this slot, and the respective weighting values of these pieces of equipments. The remaining 15% between 60% and 75% are preferably distributed in proportion to the weighting values of the electrical pieces of equipments associated with this indicator, other than that detected at a weighting value of 2 at step b) and other than those having a weighting value of 3.

The general principle of using weighting values not only enables the integration of a series of weighting criteria into the calculation of activity indicators, but also great flexibility in customizing the determination of activity indicators. Weighting values are, in fact, adaptable to the lifestyle of the person to be tracked and the level of electrical equipment of their home, enabling a fully customized determination of the various activity indicators.

At step S230 in FIG. 3, the processing server 150 determines each activity indicator relative to a given period of time, based on the weighting values determined for the electrical equipment that has been detected in this period and which is associated with this activity indicator. The activity indicator thus determined is, in fact, a probability of performance of the type of activity of which this indicator is representative. The value of this indicator is preferably defined according to a predefined scale, for example between 0 and 100%, between 0 and 10, between 0 and 1 or any other scale.

According to a variant embodiment, an activity indicator for "moving around" activity is determined from at least one value chosen from the group comprising the number of movements made between two given rooms of said environment, the total number of movements between any two rooms, the duration of occupation of a given room.

The activity of "moving around" is, in fact, a special activity whose indicator requires a suitable method of determination. Each time an electrical equipment is detected being switched on or off, it is possible to determine whether a movement between two rooms has taken place by comparing the room where the equipment is located that has just been detected and the room where the previously detected equipment is located. For example, the detection of an electric light being switched on in the kitchen, followed by an electric razor being switched on in the bathroom, implies that a movement has taken place between the kitchen and the bathroom, this movement starting in the kitchen. If the starting and finishing rooms are the same, no movement is recorded. Otherwise, a movement counter is incremented for each pair of rooms.

The concept of movement type is introduced Into the context of the invention, which corresponds to a movement between a given starting room and a given finishing room, the two rooms being separate. There is therefore a movement type corresponding to each room pair.

For the "moving around" activity indicator, the room where the equipment is located is associated with each piece of fixed equipment, and a movement type is associated with each room pair. The associations that are defined between the pieces of equipment and the rooms for determining other activity indicators are therefore also used for counting the number of movements per movement type.

The number of movements detected over a given period of time is recorded in a table, for example in the form of a matrix giving the movement number for each movement type. The table below is an example of such a record.

| | Finish | | | | | |
|---|---|---|---|---|---|---|
| Start | Kitchen | Bedroom | Dining room | Bathroom | Toilet | Total |
| Kitchen | X | 0 | 5 | 0 | 1 | 6 |
| Bedroom | 1 | X | 1 | 1 | 1 | 4 |
| Dining room | 3 | 1 | X | 1 | 3 | 8 |
| Bathroom | 1 | 1 | 0 | X | 1 | 3 |
| Toilet | 1 | 2 | 2 | 1 | X | 6 |
| Total | 6 | 4 | 8 | 3 | 6 | 27 |

Figure 4A:
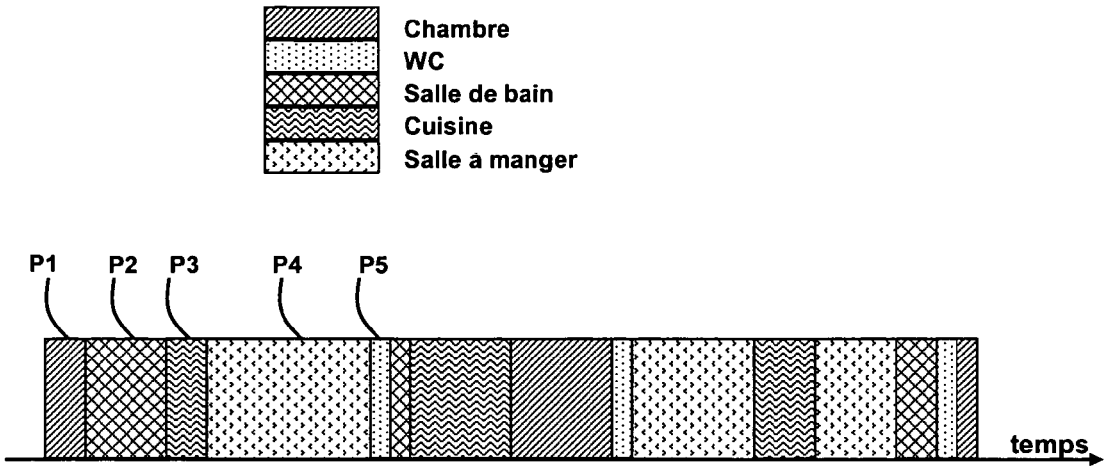
FIGS. 4*a* to 4*c* illustrate a method of calculating and using activity indicators according to a tracking process according to the invention.
Figure 4B:
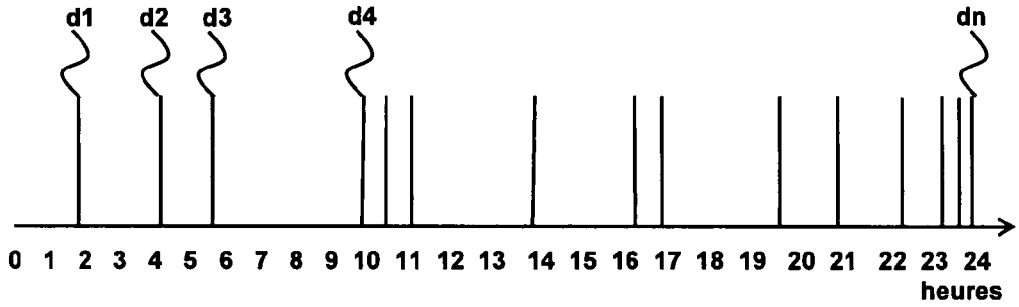

According to a variant, the occupation time of each room is measured correlatively to the measurement of the number of movements. The correlation between these two measurements is shown in FIGS. 4*a* and 4*b*. FIG. 4*a* represents an example of a time chart of room occupation during a day. Each room (bedroom, toilet, bathroom, kitchen, dining room) is identified by a rectangle with a specific pattern or hatching, according to the key to this figure. The rooms occupied are, in chronological order:

the bedroom P1, the bathroom P2, the kitchen P3, the dining room P4, the toilet P5, etc.

The movements detected are shown, also as a function of time, in FIG. 4*b*, each movement being marked on a time axis by a vertical line. The movements performed, corresponding to the rooms successively occupied, which were described in FIG. 4*a*, are, in chronological order:

movement from the bedroom to the bathroom d1, movement from the bathroom to the kitchen d2, movement from the kitchen to the dining room d3, movement from the dining room to the toilet d4, etc.

According to a variant, only movements that are consistent with respect to the time slot considered and with respect to the activity that normally occurs there, are retained for measuring the "moving around" activity indicator.

From the detection of movements and their date and time, the occupation time of each room is therefore easily deduced, together with the temporal distribution of room occupation. In preference, each room is assigned a minimum occupation time below which it is considered that there has not been any occupation of the room. In this event, the occupation is not stored in memory, and neither is the movement retained that took place correlatively.

The "moving around" global activity indicator is determined, for example by determining the total number of movements. According to a variant, this value is weighted according to the average duration of occupation of each of the rooms. That is to say, the shorter this duration, the greater the frequency of movements, which forms an indicator of greater mobility.

The operating data, comprising the activity indicators and other magnitudes related to movements or to room occupation, is then compared at step S240 of FIG. 3 with a set of reference data or reference base 241 to determine at step S250 a global relative indicator representative of the normal nature of the person's activity in their environment when examined over a given period of time. In the event of an anomaly, this global information at step S260 triggers an alert or the transmission of a message via the communication network 50 to persons capable of intervening: emergency service, doctor, member of the family, etc.

The global relative indicator determined by the processing server 150 is transmitted to the operating terminal 180. From this indicator, the operating terminal 180 determines whether an alert has to be triggered. According to a variant embodiment, the operating data is displayed on the display means 182 of the operating terminal and it is a physical person, for example a doctor 190, who is assigned to tracking the indicators and assessing whether an alert should be triggered in the light of the displayed operating data.

The reference base used at step S240 consists of reference values preferably corresponding to average values of different magnitudes corresponding to operating data obtained over a given period of time (for 24 h, for 1 h, a given time slot), which is the same as that for which the ordinary magnitude values are determined. These magnitudes include, for example:

the various activity indicators that have been disclosed above;

the number of movements performed for each movement type;

the total number of movements;

the duration of occupation of each room;

the occupation time slot(s) of each room;

the temporal distribution of movements and activities;

the temporal distribution of the occupation of different rooms;

the temporal distribution of each piece of equipment being switched on and off;

the temporal distribution of all the equipment taken together being switched on and off.

From such a reference base, it is possible to detect a number of abnormal situations of the type:

lack of, or fall in occupation of a given room;

number of movements up or down;

number of abnormal movements in a given time slot;

falling or abnormally low activity indicator.

For a given person, the average activity indicator may be low without this being abnormal for the person considered. In setting up a reference base, a measurement is given of what is "normal" for the person tracked, i.e. a statistical mean. The reference base is obtained preferably by calculating not only an average value for each magnitude of the reference base, but also a standard deviation of this magnitude's distribution. The situation is regarded as abnormal when the total number of movements determined for the period considered is less than the average value of the reference base from which a value proportional to the corresponding standard deviation has been subtracted, for example twice the standard deviation.

The same principle of abnormal character detection is applicable to the other reference base magnitudes, for example to the movement number for a given type of movement, to the average occupation time slot of a room, to the value of an activity indicator, etc.

In preference, the average values obtained by measurement are completed by an interview with the person to be tracked so as to find out their habits and possibly weight the reference base data according to these habits. The aim of this interview is also to determine whether the person is absent from their domicile at specified times in the week or in the day, so as not to trigger an alert in the event of lack of detection at these times. In preference, a distinction is made in the reference base between the values of magnitudes relating to different days of the week. The weighting values which are predetermined are also adjustable according to the results of such an interview as that already disclosed.

In preference, the reference base is updated cyclically, for example every month, every six months, or at another frequency, according to new average values detected. Accordingly, there is a continuous automatic readjustment that can be used to follow changes in the person's activity and distinguish between what is a normal change in the person's activity over time and what is the result of a one-time abnormal variation in their activity.

With this aim in view, the global relative indicator is determined by amplifying any difference between the value of an estimated magnitude and the value of the corresponding reference magnitude. Any variation, even small in relation to the normal character defined by the reference base, is amplified. For example, if a reference indicator has an average value of 75% and a standard deviation of 10%, and the estimated indicator is only 50%, the difference between this estimated indicator and the normality threshold is:

$$(75\%-2*10\%)-50\%=5\%.$$

This difference is amplified to give global relative indicator not of 100% (relative indicator representing normalcy), but a global relative indicator decreased by at least 5%, for example a global relative indicator of 80%. If, in addition, several other indicators have abnormal values, the global relative indicator will drop very quickly. The lower it is and closer to 0%, the more the abnormal character is emphasized.

The fact of generating a global relative indicator in the form of a single measurement, can be used to automatically track a large number of people from the same operating terminal insofar as it collects the specified data for all these people. This enables alerts to be triggered based on the value of this global indicator.

Figure 4C:
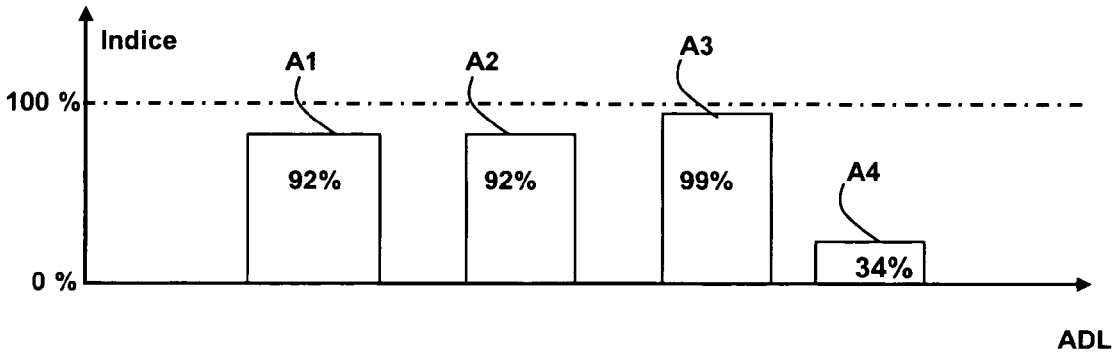

Threshold values are thus defined for this global relative indicator, each corresponding to an alert level. For example:

a global relative indicator value less than a threshold value of 80% gives rise to a first level of alert, which involves, for example, sending an e-mail or telephone message to someone close to the person tracked;

a global relative indicator value less than a threshold value of 50% gives rise to a second level of alert, which involves, for example, calling the family doctor;

a global relative indicator value less than a threshold value of 20% gives rise to a third level of alert, which involves, for example, calling the emergency services;

Optionally, the operating data is transmitted in full to the operating terminal 180 so that a person 190 assigned to processing this data, can very quickly ascertain what form of anomaly is being reported by the global relative indicator, and in particular ascertain which is/are the abnormally low activity indicator(s). This operating data is preferably visually displayed on the operating terminal 180, similar to the representations in FIGS. 4*a* to 4*c*, so as to facilitate rapid interpreting of the operating data. FIGS. 4*a* and 4*b* have already been described. FIG. 4*c* is an example of a visual representation of the values determined for the various activity indicators:

"dressing" indicator A1 with a value of 92%,

"going to the bathroom" indicator A2 with a value of 92%,

"washing" indicator A3 with a value of 99%,

"eating" indicator A4 with a value of 34%.

In conclusion, the invention enables a person's activity to be remotely tracked based on an electrical signal generated on the building's electrical power supply system, without needing to install numerous sensors. The tracking information recorded following the detections performed, is used by comparing with reference data representative of the normal character of the activity of the person to be tracked. Activity indicators are estimated according to the equipment detected and based on the statistical knowledge of the person's activity (the reference base, the person's habits), rules associating a piece of equipment with an activity, weighting criteria enabling the determination algorithm to be adapted to the person's equipment level, their living habits, the detection conditions, etc. Thus, based on very simple means of detection and a method using weighting values, the invention enables the achievement of a high degree of accuracy and reliability in tracking the person. Furthermore, the invention is suitable for the simultaneous tracking of many people, through the determination of a global relative indicator, based on which prevention measures can be triggered entirely automatically.

In addition the invention can be applied to the surveillance of any type of building, whatever the number of persons using the electrical equipments of this building, as long as the estimate of activity needs not to be determined for each person.

We claim:

1. A method for remotely tracking a person's activity in a building, comprising the steps of:

(i) obtaining, from a detection device configured to detect in said building's electrical power supply system at least one predefined electrical signal produced by a piece of electrical equipment of said building when a change of electrical operating state occurs in said piece of electrical equipment, tracking data relating to at least one detected electrical signal, said tracking data including:

(a) information relating to a detection moment of said at least one detected electrical signal, (b) identification data derived from said at least one detected electrical signal of said piece of electrical equipment which produced said at least one detected electrical signal, the detected electrical signal comprising an identifying signature of said piece of electrical equipment that produced said at least one electrical signal, and (c) data relating to said change of electrical operating state which caused said at least one detected electrical signal which comprises the identifying signature of said piece of electrical equipment that produced said at least one electrical signal; and (ii) determining, from the tracking data generated during a predefined period of time, an estimate of said person's degree of activity;

wherein said at least one electrical signal is a high frequency electrical signal representative of the electrical equipment and a nature of an action that triggered the signal.

2. The method as claimed in claim 1, wherein said estimate comprises at least one activity indicator representative of a probability of at least one type of activity being performed by said person during said period of time.

3. The method as claimed in claim 2, further including the steps of:

associating at least one piece of electrical equipment with each activity indicator;

assigning, to each piece of electrical equipment associated with an activity indicator, a weighting value that is representative of the probability of performance of the at least one type of activity represented by the activity indicator when an action causing the change of the electrical operating state of said at least one piece of electrical equipment is performed by the person on said at least one piece of electrical equipment; and determining the activity indicator from weighting values determined for said at least one piece of electrical equipment associated with the activity indicator.

4. The method as claimed in claim 2, further including the step of:

determining at least one relative activity indicator representative of a normal character of the person's activity in said building over a period of time by comparing at least one activity indicator determined for said period of time to a reference activity indicator relative to a same period of time.

5. The method as claimed in claim 4, further including the step of:

triggering an alert which is conditional upon a value of said at least one relative activity indicator.

6. The method as claimed in claim 3, wherein the weighting value relating to a specific piece of electrical equipment and a specific activity indicator is weighted according to at least one criterion chosen from among the group including:

a time of day, a total number of pieces of electrical equipment associated with said activity indicator, the total number of pieces of electrical equipment detected and associated with said activity indicator, a period during which the electrical equipment has remained switched on, a total number of times that the electrical equipment has been switched on or off, an outside temperature, a specific season, a day of the week, a degree of confidence in the identification data, the person's habits, and the total number of pieces of electrical equipment associated with the same activity indicator and switched on shortly before or shortly after the specific piece of electrical equipment.

7. The method as claimed in claim 1, further including the step of:

determining a movement indicator based on at least one value chosen from the group including a total number of movements made between two specific rooms of said building, a total number of movements between any two rooms of said building, and a duration of occupation of a specific room.

8. The method as claimed in claim 1, wherein the change of the electrical operating state of the piece of electrical equipment occurs following an action performed by the person on the piece of electrical equipment, said action belonging to a group of actions including switching the piece of electrical equipment or a subassembly of said piece of electrical equipment on or off, said tracking data indicating a nature of the action causing the change in the electrical operating state of the piece of electrical equipment.

9. A data processing device for remotely tracking a person's activity in a building, comprising:

(i) means for obtaining, from a detection device which is configured to detect in said building's electrical power supply system at least one predefined electrical signal produced by a piece of electrical equipment of said building when a change of electrical operating state occurs in said piece of electrical equipment, tracking data relating to at least one detected electrical signal, wherein said tracking data includes:

(a) information relating to a detection moment of said at least one detected electrical signal, (b) identification data derived from said at least one detected electrical signal of said piece of electrical equipment which produced said at least one detected electrical signal, the detected electrical signal comprising an identifying signature of said piece of electrical equipment that produced said at least one electrical signal, and (c) data relating to said change of electrical operating state which caused said at least one detected electrical signal which comprises the identifying signature of said piece of electrical equipment that produced said at least one electrical signal; and (ii) data processing means for determining, from tracking data generated during a predefined period of time, an estimate of said activity performed by said person;

wherein said at least one detected electrical signal is a high frequency electrical signal representative of the electrical equipment and a nature of an action that triggered the signal.

10. A device for remotely tracking a person's activity in a building, comprising:

(i) a detection module for detecting on said building's electrical power supply system at least one predefined electrical signal produced by a piece of electrical equipment of said building when a change of electrical operating state occurs in said piece of electrical equipment;

(ii) means for generating tracking data, by analysis of at least one detected electrical signal, wherein said tracking data includes:

(a) information relating to a detection moment of said at least one detected electrical signal, (b) identification data derived from said at least one detected electrical signal of said piece of electrical equipment which produced said at least one detected electrical signal, the detected electrical signal comprising an identifying signature of said piece of electrical equipment that produced said at least one electrical signal, and (c) data relating to said change of electrical operating state which caused said at least one detected electrical signal which comprises the identifying signature of said piece of electrical equipment that produced said at least one electrical signal; and (iii) data processing means for determining, from the tracking data generated during a predefined period of time, an estimate of said activity performed by the person;

wherein said at least one detected electrical signal is a high frequency electrical signal representative of the electrical equipment and a nature of an action that triggered the signal.

11. The method according to claim 1, wherein the high frequency electrical signal is not related to the electrical equipment power consumption.

12. A method for remotely tracking a person's activity in a building, comprising the steps of:

(i) obtaining, from a detection device configured to detect in said building's electrical power supply system at least one predefined electrical signal produced by a piece of electrical equipment of said building when a change of electrical operating state occurs in said piece of electrical equipment, tracking data relating to at least one detected electrical signal, said tracking data including:

(a) information relating to a detection moment of said at least one detected electrical signal, (b) identification data derived from said at least one detected electrical signal of said piece of electrical equipment which produced said at least one detected electrical signal, the detected electrical signal comprising an identifying signature of said piece of electrical equipment that produced said at least one electrical signal, and (c) data relating to said change of electrical operating state which caused said at least one detected electrical signal which comprises the identifying signature of said piece of electrical equipment that produced said at least one electrical signal; and (ii) determining, from the tracking data generated during a predefined period of time, an estimate of said person's degree of activity;

wherein the signature is an electrical signal that uniquely identifies the piece of electrical equipment based on an inherent nature of an action for operating the piece of electrical equipment.

13. A data processing device for remotely tracking a person's activity in a building, comprising:

(i) means for obtaining, from a detection device which is configured to detect in said building's electrical power supply system at least one predefined electrical signal produced by a piece of electrical equipment of said building when a change of electrical operating state occurs in said piece of electrical equipment, tracking data relating to at least one detected electrical signal, wherein said tracking data includes:

(a) information relating to a detection moment of said at least one detected electrical signal, (b) identification data derived from said at least one detected electrical signal of said piece of electrical equipment which produced said at least one detected electrical signal, the detected electrical signal comprising an identifying signature of said piece of electrical equipment that produced said at least one electrical signal, and (c) data relating to said change of electrical operating state which caused said at least one detected electrical signal which comprises the identifying signature of said piece of electrical equipment that produced said at least one electrical signal; and (ii) data processing means for determining, from tracking data generated during a predefined period of time, an estimate of said activity performed by said person;

wherein the at least one detected electrical signal is an electrical signal that uniquely identifies the piece of electrical equipment based on an inherent nature of an action for operating the piece of electrical equipment.

14. The method according to claim 13, wherein the high frequency electrical signal is not related to the electrical equipment power consumption.

15. A device for remotely tracking a person's activity in a building, comprising:

(i) a detection module for detecting on said building's electrical power supply system at least one predefined electrical signal produced by a piece of electrical equipment of said building when a change of electrical operating state occurs in said piece of electrical equipment;

(ii) means for generating tracking data, by analysis of at least one detected electrical signal, wherein said tracking data includes:

(a) information relating to a detection moment of said at least one detected electrical signal, (b) identification data derived from said at least one detected electrical signal of said piece of electrical equipment which produced said at least one detected electrical signal, the detected electrical signal comprising an identifying signature of said piece of electrical equipment that produced said at least one electrical signal, and (c) data relating to said change of electrical operating state which caused said at least one detected electrical signal which comprises the identifying signature of said piece of electrical equipment that produced said at least one electrical signal; and (iii) data processing means for determining, from the tracking data generated during a predefined period of time, an estimate of said activity performed by the person wherein the at least one detected electrical signal is an electrical signal that uniquely identifies the piece of electrical equipment based on an inherent nature of an action for operating the piece of electrical equipment.

16. The method according to claim 15, wherein the high frequency electrical signal is not related to the electrical equipment power consumption.

* * * * *